US005304096A

United States Patent [19]

Wilk

[11] Patent Number: 5,304,096

[45] Date of Patent: Apr. 19, 1994

[54] ENTERTAINMENT SYSTEM AND ASSOCIATED METHOD

[76] Inventor: Peter J. Wilk, 185 W. End Ave., New York, N.Y. 10023

[21] Appl. No.: 943,392

[22] Filed: Sep. 10, 1992

[51] Int. Cl.[5] ..... A63H 13/16

[52] U.S. Cl. ..... 472/137; 472/54; 446/475; 40/427

[58] Field of Search ..... 472/137, 51, 56, 54, 472/52, 53, 66; 446/297, 298, 475, 397, 398; 40/455, 427, 463

[56] References Cited

U.S. PATENT DOCUMENTS

| | | | |
|---|---|---|---|
| 2,588,146 | 2/1950 | Miller | 472/51 |
| 4,786,048 | 11/1988 | Lahti et al. | 472/51 X |
| 4,903,424 | 2/1990 | Satoh et al. | 472/137 X |
| 4,903,958 | 2/1990 | DiCarlo et al. | 472/54 |
| 4,946,745 | 8/1990 | Kempa | 472/137 X |
| 5,073,140 | 12/1991 | Lebensfeld et al. | 446/297 |
| 5,234,726 | 8/1993 | Dahan | 428/9 |

*Primary Examiner*—Carl D. Friedman
*Assistant Examiner*—Kien Nguyen
*Attorney, Agent, or Firm*—R. Neil Sudol; Henry D. Coleman

[57] ABSTRACT

An entertainment system comprises a housing, a first ejection mechanism in the housing for ejecting a first entertainment device from the housing, a second ejection mechanism in the housing for ejecting a second entertainment device from the housing, and a control unit operatively connected to the first ejection mechanism and the second ejection mechanism for sequencing the operation of the first ejection mechanism and the second ejection mechanism. Upon lapse of a predetermined interval after ejection of the first entertainment device such as confetti or streamers from the housing, a second entertainment device such as sparklers or fireworks spinners is automatically ejected from the housing. Predetermined sound effects such as music may be generated in a predetermined synchrony with the ejection of the entertainment devices.

24 Claims, 2 Drawing Sheets

ENTERTAINMENT SYSTEM AND ASSOCIATED METHOD

BACKGROUND OF THE INVENTION

This invention relates to a system for providing entertainment. This invention also provides a method for entertaining.

Certain occasions in life are traditionally celebrated with noise and the throwing of confetti, rice, streamers, etc. Such occasions include the New Year, of course, but also include other, less grand occasions such as birthdays. On such relatively private occasions, it would be desirable to provide a celebration which would be difficult, if not impossible, to adequately prepare. In contrast to the grander, more public occasions, there are a limited number of people present. Sometimes such people are children and others who are incapable of contributing to a synchronized celebration but who would greatly enjoy a celebration of noise and controlled mess making.

OBJECTS OF THE INVENTION

An object of the present invention is to provide an entertainment system and/or an associated method.

Another object of the present invention is to provide an entertainment device which is self-contained and disposable.

Another, more particular, object of the present invention is to provide such an entertainment device which throws objects into the air in a celebration type action.

A further particular object of the present invention is to provide such a device which is preprogrammed to deliver or eject into the air a sequence of entertainment devices.

These and other objects of the invention will be apparent from the descriptions and illustrations provided herein.

SUMMARY OF THE INVENTION

An entertainment system comprises, in accordance with the present invention, a housing, a first ejection mechanism in the housing for ejecting a first entertainment device from the housing, a second ejection mechanism in the housing for ejecting a second entertainment device from the housing, and a control unit operatively connected to the first ejection mechanism and the second ejection mechanism for sequencing the operation of the first ejection mechanism and the second ejection mechanism.

Pursuant to another feature of the present invention, the system further comprises an audio generator disposed in the housing and operatively connected to the control unit for generating predetermined sounds, e.g., music, in response to signals from the control means.

Pursuant to a further feature of the present invention, one or the other entertainment device is a streamer or a predetermined amount of confetti. Alternatively, or additionally, at least one of the entertainment devices is a fireworks device. In that event, the system further comprises an ignition disposed in the housing and operatively connected to the fireworks device for initiating oxidation of combustible materials in the fireworks device.

Where an entertainment device is a streamer or confetti, the device is ejected completely away from the housing. Where the device is firworks, such as a sparkler or a spinner, the device remains attached to the housing.

One or more of the entertainment devices may be a graphic or an alphanumeric representation.

A manual activator such as a pushbutton may be mounted to the housing and operatively connected to the control unit for initiating sequencing operations by the control unit.

Generally, the housing is placed in a desired location, such as on a gound surface or a table top. When the audience is ready, the pushbutton on the housing is pressed to activate the control unit, thereby initiating a preprogrammed sequence. In more expensive versions of the entertainment system, a keyboard may be provided for enabling a user to select a sequence of activation of the different entertainment devices.

A method for providing an entertainment comprises, in accordance with the present invention, the steps of (a) providing a housing, (b) automatically ejecting a first entertainment device from the housing, and (c) automatically ejecting a second entertainment device from the housing upon lapse of a predetermined interval after ejection of said first entertainment device.

According to another feature of the present invention, the method further comprises the step of generating predetermined sounds such as musical notes and cords in a predetermined synchrony with the ejection of the first entertainment device and the second entertainment device.

More specifically, one or more entertainment devices is completely ejected away from the housing or box during the preprogrammed entertainment sequence. Such entertainment devices may include streamers and/or confetti. Alternatively or additionally, one or more entertainment devices may be only partially ejected from the housing, in that they remain attached to the housing upon ejection. Such devices include fireworks such as spinners and sparklers which are advantageously held by the housing for safety reasons.

Where a fireworks device is ejected from the housing, the method further comprises the step of initiating oxidation of combustible materials in the fireworks device.

According to another feature of the present invention, a graphic representation such as a clown face or an alphanumeric representation such as a birthday wish is ejected from the housing. Such a representation is perhaps best ejected at the termination of the entertainment program, for example, during a finale wherein several different kinds of entertainment devices are ejected and sounds effects are orchestrated together.

An entertainment system and associated method in accordance with the present invention provides a party-like celebration in a box. Different entertainment devices such as confetti and sparklers are ejected in a preprogrammed sequence, optionally together with the playing of a musical program, to provide a diversion to children and adults on special occasions.

An entertainment system in accordance with the present invention is self-contained and includes everything needed in one package. It is not necessary to purchase bags of confetti and streamers and fireworks separately. Nothing is left over after the entertainment or celebration is completed. The entire box may be discarded.

DETAILED DESCRIPTION

Figure 1A:
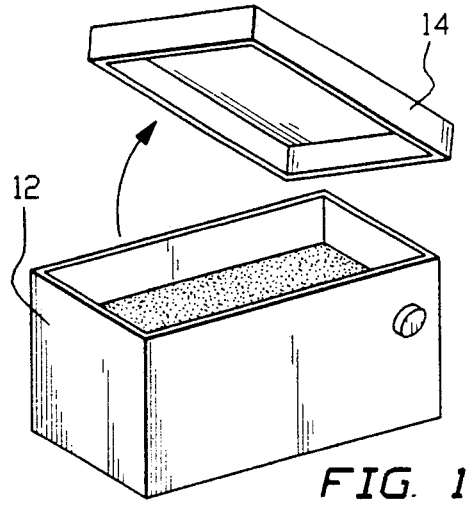
FIGS. 1A-1F are schematic perspective views showing a sequence of consecutive stages in an automatic entertainment in accordance with the present invention.

As illustrated in FIG. 1A, an entertainment housing or box 12 has arrived upon order from a central mailing facility. A lid 14 is removed and the box is placed on a table top, out of reach of young children. Everyone is instructed to stay a minimum pre-established distance (three or four feet) from the entertainment box 12.

Upon the pressing of an activation pushbutton or switch 16 (FIGS. 1B and 2) on box 12, a plurality of entertainment devices are activated in a preprogrammed sequence, depicted in an exemplary embodiment in FIGS. 1B-1F.

Figure 1B:
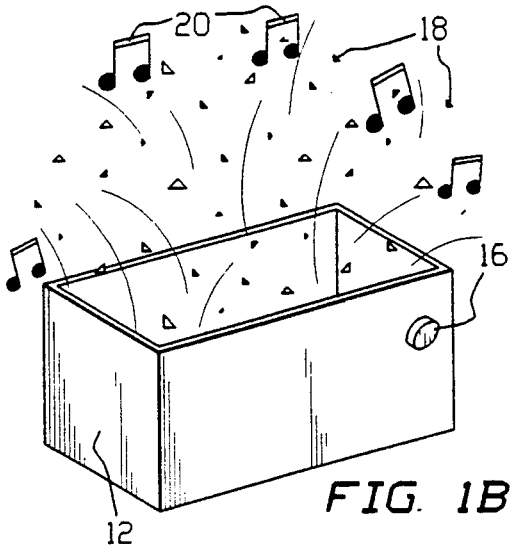
Figure 1C:
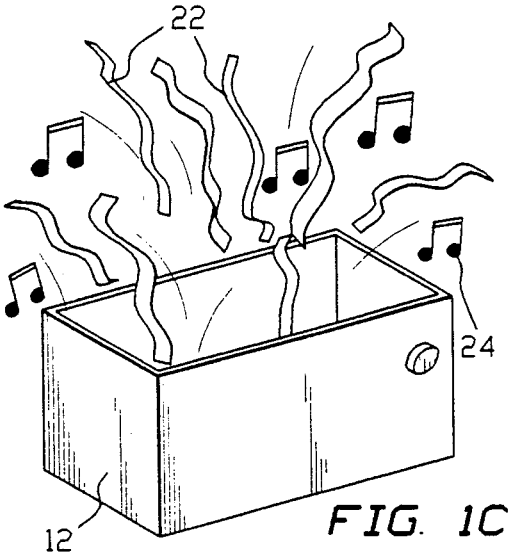
Figure 1D:
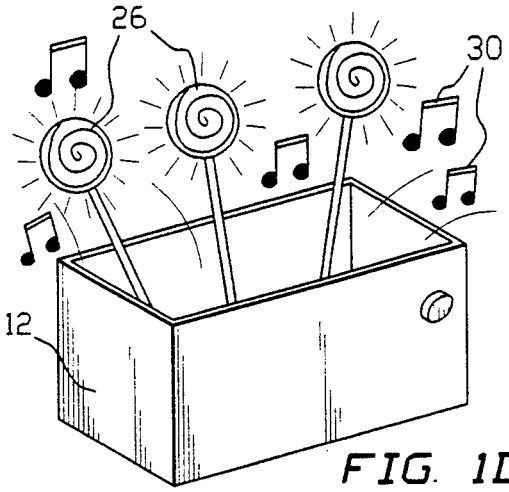
Figure 1E:
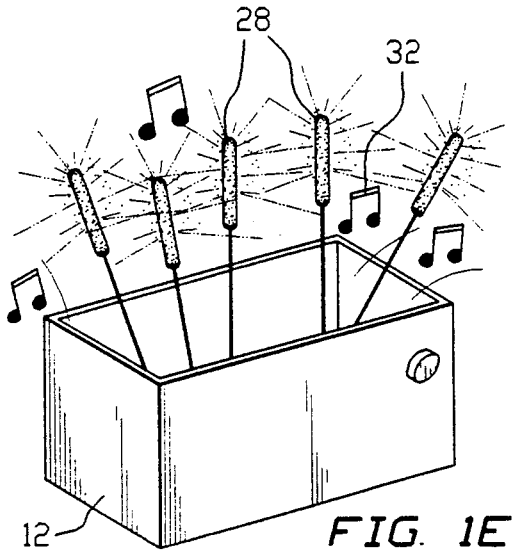
Figure 1F:
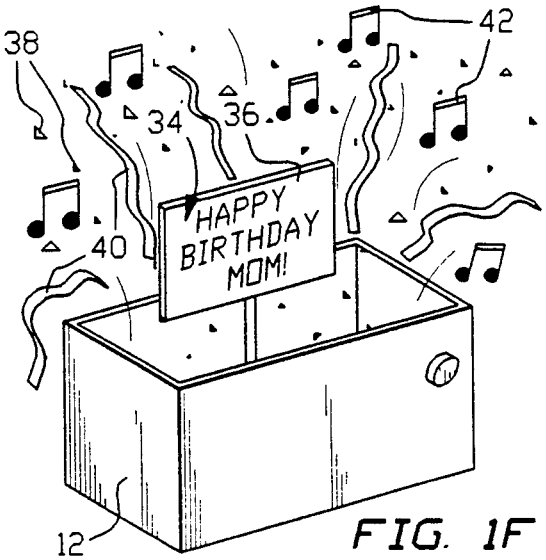

As schematically depicted in FIG. 1B, confetti 18 is ejected from the opened upper side of box 12 while musical notes 20 or other sound effects are generated inside box 12. In a subsequent step shown in FIG. 1C, streamers 22 are ejected from the upper side of box 12. Further musical notes 24 are played or generated during the time that streamers 22 are flying from the top of box 12. Upon the ejection of streamers 22, one or more fireworks such as spinners 26 (FIG. 1D) and/or sparklers 28 (FIG. 1E) appear above box 12. Musical notes 30 and/or 32 continue to be heard from box 12. Finally, a graphic or alphanumeric representation 34 on a sign or shield 36 is ejected from box 12 during a finale sequence illustrated in FIG. 1F. Other entertainment devices (e.g., more confetti 38 and streamers 40) are ejected from box 12 during the finale. The sound effects 42 also change to express a heightened celebration.

Figure 2:
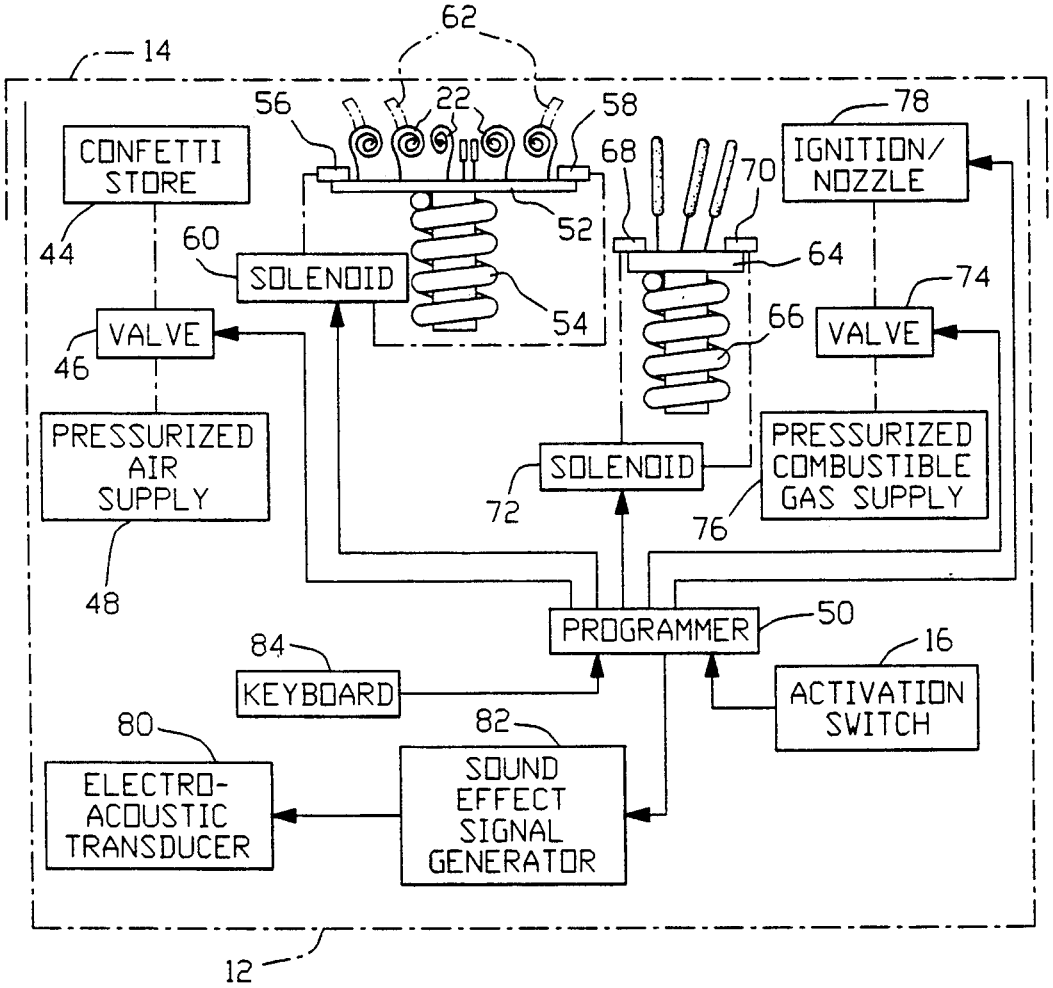
FIG. 2 is a block diagram illustrating functional components of an entertainment box shown in operation in FIGS. 1A-1F.

As illustrated in FIG. 2, box 12 contains at least one confetti store 44 for holding confetti particles 18 and 38. Store 44 is connected to a source of pressurized air 46 via a valve/nozzle 48 which is opened in response to signals from a programmer 50, thereby jetting confetti particles 18 or 38 into the air above box 12. Streamers 22 or 40 are thrown from box 12 by a platform 52 which is rapidly moved in an upward direction by a compressed helical spring 54 upon the release of locking elements 56 and 58 by a solenoid(s) 60. Solenoid 60 is energized by programmer 50 at a predetermined time during a preprogrammed entertainment sequence. Rails or tracks 62 may be provided in box 12 for guiding streamers 22 or 40 along predefined trajectories relative to box 12.

Sparklers 28 are attached to a platform 64 which is shifted by a comressed helical spring 66 from a storage position inside box 12 into a use position wherein sparklers 28 extend outside of box 12. Platform 64 is locked in the storage position by elements 68 and 70 which are actuated by a solenoid(s) 72 under the control of programmer 50 at a predetermined point during an entertainment sequence.

Prior to an ejection of sparklers 28, programmer 50 opens a valve 74 which enables a flow of combustible gas from a pressurized source 76 to an ignition nozzle(s) 78. Programmer 50 energizes an ignition element (not separately illustrated) of nozzle 78 at a pre-established time to generate a jet of burning gas which is directed by nozzle(s) 78 at the free ends of sparklers 28 to ignite the sparklers prior to the ejection thereof from box 12.

Spinners 26 are ignited and ejected by components (not illustrated) similar to those described above with reference to sparklers 28.

As further illustrated in FIG. 2, box 12 contains an electroacoustic transducer or speaker 80 which is connected to a sound effect signal generator 82 in turn coupled to programmer 50. In response to signals from programmer 50, signal generator 82 produces an acoustic frequency electrical signal for inducing speaker 80 to generate preprogrammed sound effects such as musical notes 20, 24, 30, 32, 42.

A keyboard 84 may be provided on housing 12 for enabling a user to select different preprogrammed entertainment sequences and different kinds of sound effects. For example, pressing one button of keyboard 84 may elicit a birthday sequence, with a "Happy Birthday" message 34 on sign or shield 36 and a "Happy Birthday" song from signal generator 82, while pressing another button results in a New Year's sequence, with New Year sound effects.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. An entertainment system comprising:

a housing;

first ejection means in said housing for ejecting a first entertainment device from said housing;

second ejection means in said housing for ejecting a second entertainment device from said housing, said second ejection means being different from said first ejection means; and control means operatively connected to said first ejection means and said second ejection means for operating said second ejection means a predetermined interval after operating said first ejection means to product a three-dimensional entertainment display which varies over a significantly extended time period.

2. The system defined in claim 1, further comprising audio means disposed in said housing and operatively connected to said control means for generating predetermined sounds in response to signals from said control means.

3. The system defined in claim 2 wherein said sounds are musical sounds.

4. The system defined in claim 1 wherein at least one of said first entertainment device and said second entertainment device is a streamer.

5. The system defined in claim 1 wherein at least one of said first entertainment device and said second entertainment device is a predetermined amount of confetti.

6. The system defined in claim 1 wherein at least one of said first entertainment device and said second entertainment device is a fireworks device, further comprising ignition means disposed in said housing and operatively connected to said fireworks device and said second entertainment device for initiating oxidation of combustible materials in said fireworks device.

7. The system defined in claim 1 wherein at least one of said first entertainment device and said second entertainment device is ejected completely away from said housing.

8. The system defined in claim 1 wherein at least one of said first entertainment device and said second entertainment device remains attached to said housing.

9. The system defined in claim 1 wherein at least one of said first entertainment device and said second entertainment device constitutes a graphic representation.

10. The system defined in claim 1 wherein at least one of said first entertainment device and said second entertainment device constitutes an alphanumeric representation.

11. The system defined in claim 1, further comprising manual activator means mounted to said housing and operatively connected to said control means for initiating sequencing operations by said control means.

12. The system defined in claim 1 wherein said second entertainment device is different in kind from said first entertainment device.

13. A method for providing an entertainment, comprising the steps of:

providing a housing containing first ejection means for ejecting a first entertainment device from said housing and second ejection means for ejecting a second entertainment device from said housing, said second entertainment device being different from said first entertainment device;

automatically operating said first ejection means to eject said first entertainment device from said housing; and upon lapse of a predetermined interval after ejection of said first entertainment device, automatically operating said second ejection means to eject said second entertainment device from said housing.

14. The method defined in claim 13, further comprising the step of generating predetermined sounds in a predetermined synchrony with the ejection of said first entertainment device and said second entertainment device.

15. The method defined in claim 14 wherein said sounds are musical sounds.

16. The method defined in claim 13 wherein at least one of said first entertainment device and said second entertainment device is a streamer.

17. The method defined in claim 13 wherein at least one of said first entertainment device and said second entertainment device is a predetermined amount of confetti.

18. The method defined in claim 13 wherein at least one of said first entertainment device and said second entertainment device is a fireworks device, further comprising the step of initiating oxidation of combustible materials in said one of said first entertainment device and said second entertainment device.

19. The method defined in claim 13 wherein at least one of said first entertainment device and said second entertainment device is ejected completely away from said housing.

20. The method defined in claim 13 wherein at least one of said first entertainment device and said second entertainment device remains attached to said housing.

21. The method defined in claim 13 wherein at least one of said first entertainment device and said second entertainment device constitutes a graphic representation.

22. The method defined in claim 13 wherein at least one of said first entertainment device and said second entertainment device constitutes an alphanumeric representation.

23. An entertainment system comprising:

a housing having a lower main housing portion and a lid member removably attached thereto;

a first entertainment device disposed in a first rest position in said main housing portion;

a second entertainment device disposed in a second rest position in said main housing portion, said second entertainment device being different in kind from said first entertainment device;

first ejection means disposed in said main housing portion for shifting said first entertainment device from said first rest position to a first exposed position substantially outside said main housing portion;

said ejection means in said main housing portion for shifting a second entertainment device from said second rest position to a second exposed position substantially outside said main housing portion; and control means operatively connected to said first ejection means and said second ejection means for sequencing the operation of said first ejection means and said second ejection means to produce a three-dimensional entertainment display which varies over a significantly extended time period.

24. The system defined in claim 23, further comprising audio means disposed in said main housing portion and operatively connected to said control means for generating predetermined sounds in response to signals from said control means.

* * * * *